US005090879A

United States Patent [19]

Weinbrecht

[11] Patent Number: 5,090,879

[45] Date of Patent: Feb. 25, 1992

[54] RECIRCULATING ROTARY GAS COMPRESSOR

[76] Inventor: John F. Weinbrecht, 601 Oakwood Loop, NE., Albuquerque, N. Mex. 87123

[21] Appl. No.: 529,288

[22] Filed: May 29, 1990

Related U.S. Application Data

[63] Continuation-in-part of Ser. No. 368,873, Jun. 20, 1989, abandoned.

[51] Int. Cl.[5] ..... F04C 18/18; F04C 23/00

[52] U.S. Cl. ..... 418/9; 418/15; 418/180; 418/206

[58] Field of Search ..... 418/9, 15, 180, 206

[56] References Cited

U.S. PATENT DOCUMENTS

| | | | |
|---|---|---|---|
| 973,679 | 10/1910 | Machlet | 418/206 |
| 2,489,887 | 11/1949 | Houghton | 418/180 |
| 2,906,448 | 9/1959 | Lorenz | 418/206 |
| 3,059,396 | 10/1962 | Thees | 418/9 |
| 3,531,227 | 9/1970 | Weatherston | 418/180 |
| 3,808,835 | 5/1974 | Weatherston | 62/510 |
| 4,390,331 | 6/1983 | Nachtrieb | 418/206 |
| 4,453,901 | 6/1984 | Zimmerly | 418/206 |
| 4,859,158 | 8/1989 | Weinbrecht | 418/9 |

FOREIGN PATENT DOCUMENTS

| | | | |
|---|---|---|---|
| 2027272 | 12/1971 | Fed. Rep. of Germany | 418/206 |
| 778367 | 12/1934 | France | 418/9 |
| 282752 | 5/1928 | United Kingdom . | |

OTHER PUBLICATIONS

*Roots DVJ Dry Vacuum Whispair Blowers*, Dresser Industries Inc., Connersville, Indiana, Apr. 1982.

*Vacuum Generation by Means of Roots Vacuum Pumps*, Balzers Co., Hudson, N.H., May 1985.

*Primary Examiner*—John J. Vrablik

*Attorney, Agent, or Firm*—William A. Eklund

[57] ABSTRACT

A positive displacement, recirculating Roots-type rotary gas compressor which operates on the basis of flow work compression. The compressor includes a pair of large diameter recirculation conduits (24 and 26) which return compressed discharge gas to the compressor housing (14), where it is mixed with low pressure inlet gas, thereby minimizing adiabatic heating of the gas. The compressor includes a pair of involutely lobed impellers (10 and 12) and an associated port configuration which together result in uninterrupted flow of recirculation gas. The large diameter recirculation conduits equalize gas flow velocities within the compressor and minimize gas flow losses. The compressor is particularly suited to applications requiring sustained operation at higher gas compression ratios than have previously been feasible with rotary pumps, and is particularly applicable to refrigeration or other applications requiring condensation of a vapor.

18 Claims, 9 Drawing Sheets

RECIRCULATING ROTARY GAS COMPRESSOR

The United States Government has rights in this invention pursuant to Contract W-7405-ENG-36 awarded by the United States Department of Energy.

This is a continuation-in-part of the applicant's parent U.S. patent application Ser. No. 07/368,873, filed June 20, 1989, abandoned.

BACKGROUND OF THE INVENTION

1. Field of the Invention

The present invention is generally related to gas pumps and compressors. More particularly, the present invention is related to positive displacement rotary compressors, including Roots blowers and compressors, and to such compressors in applications of refrigeration and condensation.

2. Description Of Related Art Including Information Disclosed Under 37 CFR 1.97–1.99

The class of positive displacement gas Compressors known as Roots compressors, or Roots blowers, has been known and used in industry for over a hundred years. It is well recognized in industry that for certain applications Roots compressors offer a number of advantages over other types of gas pumps and compressors, for example conventional piston-and-cylinder reciprocating pumps, fan-type blowers and turbine pumps. Among these advantages are simplicity, ruggedness, trouble-free operation, and high volumetric capacity. Roots compressors have no valves, pistons or other reciprocating mechanical parts. Additionally, Roots compressors have little or no backflow, even when the compressor is not operating. A typical application of a Roots compressor is the transfer or evacuation of large amounts of toxic or corrosive gas, where it is important to rapidly pump large amounts of gas with little or no backflow. In this type of application reciprocating pumps are relatively inefficient, and fan-type blowers and turbine pumps cannot provide a seal against backflow.

Roots compressors most commonly include two lobed impellers, sometimes also called rotors, which intermesh with one another and rotate in opposite directions in synchronization within a housing. The impeller operate to sweep a gas through the housing from an intake manifold at one end of the housing to an output manifold at the opposite end of the housing. Although commercially available Roots compressors most commonly include impellers having only two lobes, Roots compressors have also been designed to include impellers having three, four and even more lobes. Two-lobed impellers are the most common, however, for several reasons. One reason is that they are simpler to construct and maintain. Also, they are characterized by a relatively higher volumetric efficiency. This high efficiency is due to the fact that the volumetric efficiency of a Roots compressor is generally inversely proportional to the proportion of the compressor chamber that is occupied by the impellers; and two-lobed impellers generally occupy a smaller volume than impellers having more lobes.

Roots compressors are extraordinarily efficient for the purpose of rapidly moving large volumes of gas where there is a relatively small pressure gradient across the compressor. Roots compressors have not heretofore been of useful application for the purpose of pumping a gas against a substantial pressure differential. This limitation has been due to heating effects which attend such pumping. As as gas is swept through a conventional Roots compressor from a region of relatively low pressure to a region of relatively higher pressure, it is compressed and heated. Such compression is essentially adiabatic, such that the temperature of the gas increases exponentially with increasing pressure ratios. The increase in the temperature of the gas leads to heating of the impellers, the housing and the other mechanical parts of the pump. This in turn can lead to thermal distortion, expansion and friction. At pressure ratios of greater than about two to one (2:1) such effects become a significant problem and essentially limit the sustained capacity of the compressor. Overheating of the compressor can result in lockup or other mechanical failure of the seals, impeller and other compressor components.

This heating problem is not uniform throughout the compressor. The compressor housing, for example, can be externally cooled by a number of conventional methods, such as the use of integral double-walled water jackets, heat radiating fins, heat sinks, and the like. The greatest heating problem however lies with the impellers, because there is no practical way to directly cool the impellers. Overheating of the impellers leads to their expansion and eventual binding against the housing, possibly causing extensive damage to the compressor. Overheating of the Roots compressor has thus been one of the major limitations on the use of Roots compressors for pumping gas against high pressure differentials, and for this reason commercially available Roots compressors are typically limited to pressure ratios of less than about four to one (4:1).

Perhaps the most simple and straightforward method of avoiding the adverse effects of overheating is to increase the clearances between the impellers and the housing, thereby allowing the impellers to expand somewhat on heating without rubbing and locking up against the housing. This however necessarily leads to increased gas leakage and backflow, and thereby degrades the volumetric efficiency of the compressor. For this reason, this approach has not generally been considered a satisfactory solution to the overheating problem.

A substantial advance in the art was the development of recirculation cycles to effect a moderate reduction in the heating of Roots compressors. In a recirculating Roots compressor, a portion of the output gas, which is compressed to a higher pressure than the input gas, is recirculated back into the compressor so as to effectively increase the pressure of the gas passing through the compressor. In some recirculating compressors a portion of the output gas is cooled prior to being recirculated back into the compressor. In both cases the operating temperature of the compressor is effectively reduced, thereby mitigating the overheating problems referred to above.

U.S. Pat. No. 2,489,887 to Houghton, for example, discloses the general concept of cooling the impellers of a Roots compressor by introducing recirculated gas of a lower temperature into the intake gas to reduce heating of the impellers.

U.S. Pat. No. 3,351,227 to Weatherston discloses a multi-lobed Roots-type compressor having feedback passages which allow a portion of the high-pressure discharge gas to be recirculated back into the pump housing. Weatherston however discloses only the use of quite small feedback passages, the size of which are unrelated to the sizes of the intake and discharge ducts.

This results in uneven flow velocities and pressures. As will be apparent from the description of the present invention set forth below, this does not solve the flow problems addressed by the present invention.

German Patent 2,027,272 to Kruger discloses the concept of cooling and recirculating discharge gas in a two-lobed Roots compressor. The compressor of Kruger, due to its two-lobed configuration, has no provision for preventing backflow from the discharge port into the recirculation ports.

French Patent 778,361 to Bucher discloses four-lobed Roots compressors having recirculation ports. The recirculation ports are however small, with the intended purpose of using small nozzle-like ports being to allow the recirculated gas to adiabatically cool upon entry into the compressor housing. As will be apparent from the description below, this teaching of Bucher is contrary to the present invention.

U.S. Pat. No. 4,453,901 to Zimmerly discloses a positive displacement rotary pump which is designed for pumping liquids, and which contains no provision for recirculation.

U.S. Pat. No. 4,390,331 to Nachtrieb discloses rotary compressor having four-lobed impellers, but likewise having no provision for recirculation.

U.S. Pat. No. 2,906,448 to Lorenz discloses a rotary positive displacement compressor having two-lobed impellers, with a double-walled construction for cooling purposes.

British Patent 282,752 to Kozousek discloses a rotary pump which is characterized by rotor lobes which are particularly shaped so as to provide the maximum possible working space and thereby maximize the volumetric efficiency of the pump. The pump disclosed in Kozousek discloses recirculation ports which are deliberately made small, and which are for the purpose of obtaining even delivery of gas.

Various kinds of Roots compressors are commercially available, both with and without recirculation. However, none of the commercially available compressors address the problems of recirculation flow impedance and flow velocity equalization which are addressed by the present invention.

In some prior art recirculating Roots compressors, such as the compressor described disclosed in Houghton, the flow of recirculating gas is either periodically interrupted each time a rotor lobe passes the recirculation entry port, or is halted and possibly even reversed as a displacement cavity is simultaneously opened to both a recirculation port and a discharge port. This results in a loss of momentum and flow of the recirculation fluid, reducing the efficiency of the recirculation fluid in cooling the compressor. This problem, which is inherent in many previously known Roots compressors, is overcome in the will be made apparent by the present invention, as descriptions set forth below.

Accordingly, it is the object and purpose of the present invention to provide an improved positive displacement rotary gas compressor.

It is also an object and purpose of the present invention to provide a positive displacement rotary gas compressor having an improved gas recirculation means for reducing overheating of the compressor, It is a further object and purpose of the present invention to provide a positive displacement rotary gas compressor which is characterized by having a continuous, uninterrupted flow of recirculation fluid which flows from the output of the compressor back into the compressor.

It is also an object and purpose of the present invention provide a positive displacement rotary gas compressor that produces less heat inside the compressor and is thus capable of operating at higher pressure ratios than have been previously available.

It is also an object of the present invention to provide a positive displacement rotary gas compressor that is particularly suited for use in combination with a vapor condenser, for example for compressing condensable gases as in a refrigeration apparatus.

It is yet another object of the present invention to provide a rotary gas compressor which utilizes flow work to achieve improved efficiency through substantially isothermal gas compression.

SUMMARY OF THE INVENTION

The present invention provides a positive displacement, recirculating rotary compressor characterized by inlet, discharge, and recirculation ports and conduits which are arranged so as to minimize flow impedance and equalize flow velocities, to thereby minimize flow losses and associated overheating of the compressor. For reasons which will be apparent from the following description, the present invention is also referred to herein as a flow work compressor.

The present invention integrates an open flow recirculation system, operating at output pressure, with a multi-lobed Roots type rotary compressor. The compressor feeds input pressure gas into a recirculation system at constant temperature through flow work. Power for the flow work is supplied by equivalent shaft work.

The compressor of the present invention comprises a housing having mutually opposing cylindrically curved interior side walls, and having a gas inlet port located at one end of the housing between the cylindrically curved interior side walls. The compressor housing further includes a gas discharge port located at the opposite end of the housing from the inlet port, and which is also located between the cylindrically curved side walls. The compressor housing further includes first and second gas recirculation ports formed respectively in the cylindrically curved opposing side walls between the inlet port and the discharge port. The discharge port is connected in fluid communication with a discharge conduit, and the compressor further includes first and second recirculation conduit means connected in fluid communication with the discharge conduit and connecting the discharge conduit respectively to the first and second recirculation ports. The inlet port and the discharge port are approximately equal in size to one another, and the discharge port is approximately twice the size of each of the recirculation ports. The inlet, discharge and recirculation ports are isolated from direct fluid communication with one another and are sized as large as possible within the constraints of the foregoing relationships.

The compressor further includes a pair of intermeshed, involutely lobed impellers which are rotatably journalled in the housing. The impellers are driven to rotate in opposite directions so as sweep a gas from the inlet port to the discharge port.

The lobes of the impellers are shaped so as to not completely obstruct the recirculation ports, and thereby not momentarily interrupt the flow of recirculation gas, as the impellers rotate past the recirculation ports. Additionally, the number of lobes of the impellers and the angular reach of the cylindrically curved interior housing More particularly, the angular side walls are related. sectors through which the wall surfaces extend, between each of the recirculation ports and the discharge port, and also between each of the recirculation ports and the inlet port, are preferably selected so as to be no greater than the angular relationship between adjacent lobes of the impellers.

It will be appreciated that this arrangement results in minimum flow impedance in the several conduits, while also ensuring that the inlet port, the recirculation ports, and the discharge port are at all times during operation isolated from one another by the rotor lobes so as to prevent backflow due to direct fluid communication between the ports.

In another preferred embodiment, the impellers are each provided with six lobes. Further, the opposing interior housing walls extend through angular sectors of approximately sixty (60) degrees between the proximal edges of the outlet port and the each of the recirculation ports; and extend through angular sectors of approximately one hundred and twenty (120) degrees between the proximal edges input port and the recirculation ports. This embodiment is preferred because it results in lower slippage, or backflow, and is thereby characterized by improved volumetric efficiency.

The compressor of the present invention is particularly adapted for use in a condensation cycle, such as in a refrigerator. In this application the compressor is coupled to a suitable condenser. In this application there is the advantage of efficient vapor compression and condensation in large volumes and at high flow rates, and which may be conducted with ordinary refrigerant fluids. In this application, wet compression or liquefaction within the compressor itself is desirable, as it leads to cooling of the compressor and further seals the compressor against vapor backflow or leakage.

These and other aspects of the present invention will be more apparent upon consideration of the more detailed description of the invention set forth below and the accompanying drawings.

BRIEF DESCRIPTION OF THE DRAWINGS

The accompanying drawings are incorporated into and form a part of this specification and, when taken in combination with the detailed description below, illustrate the operation and construction of the best mode of the invention known to the inventor.

In the Figures.

DESCRIPTION OF THE PREFERRED EMBODIMENT

Figure 1:
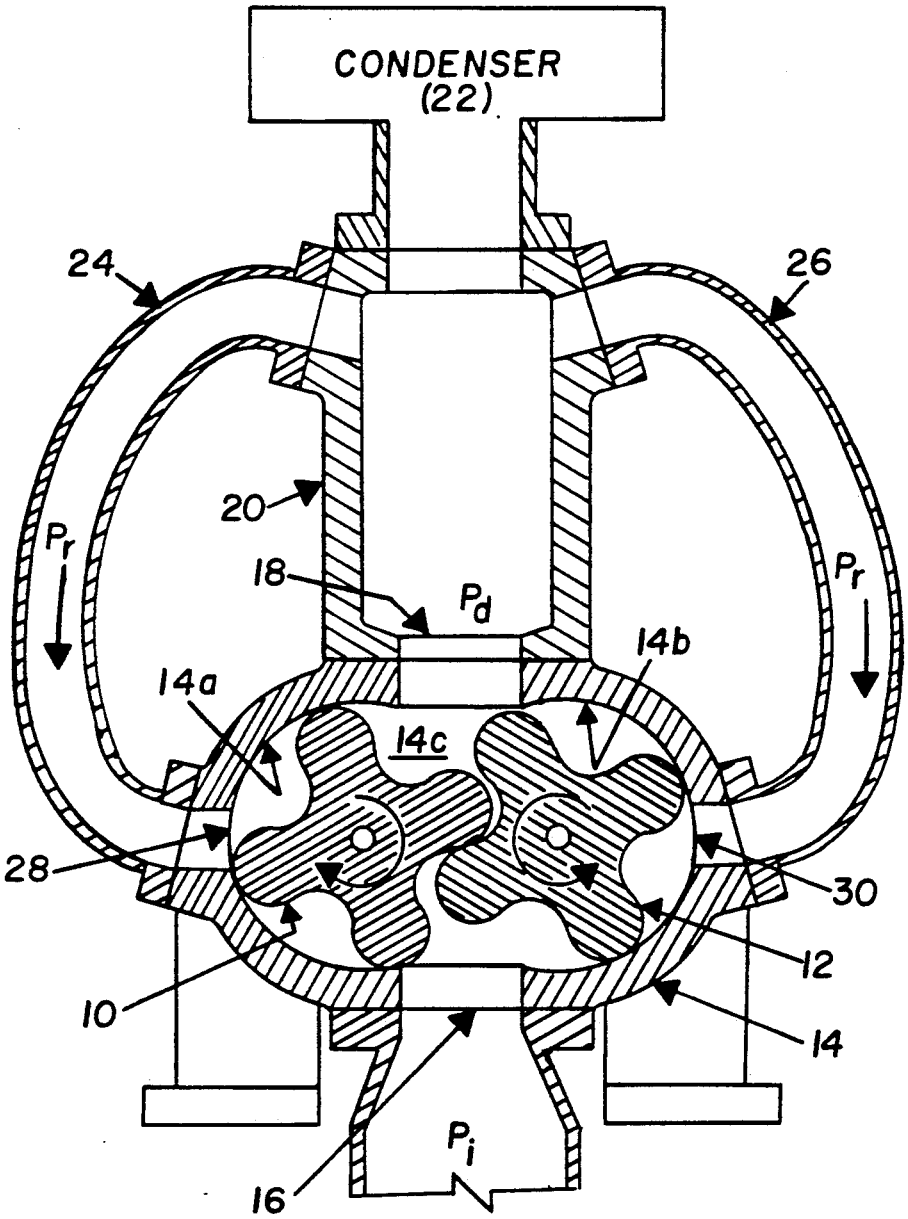
FIG. 1 is a side view in cross-section of the preferred embodiment of the present invention, in combination with a vapor condenser.
Figure 9:
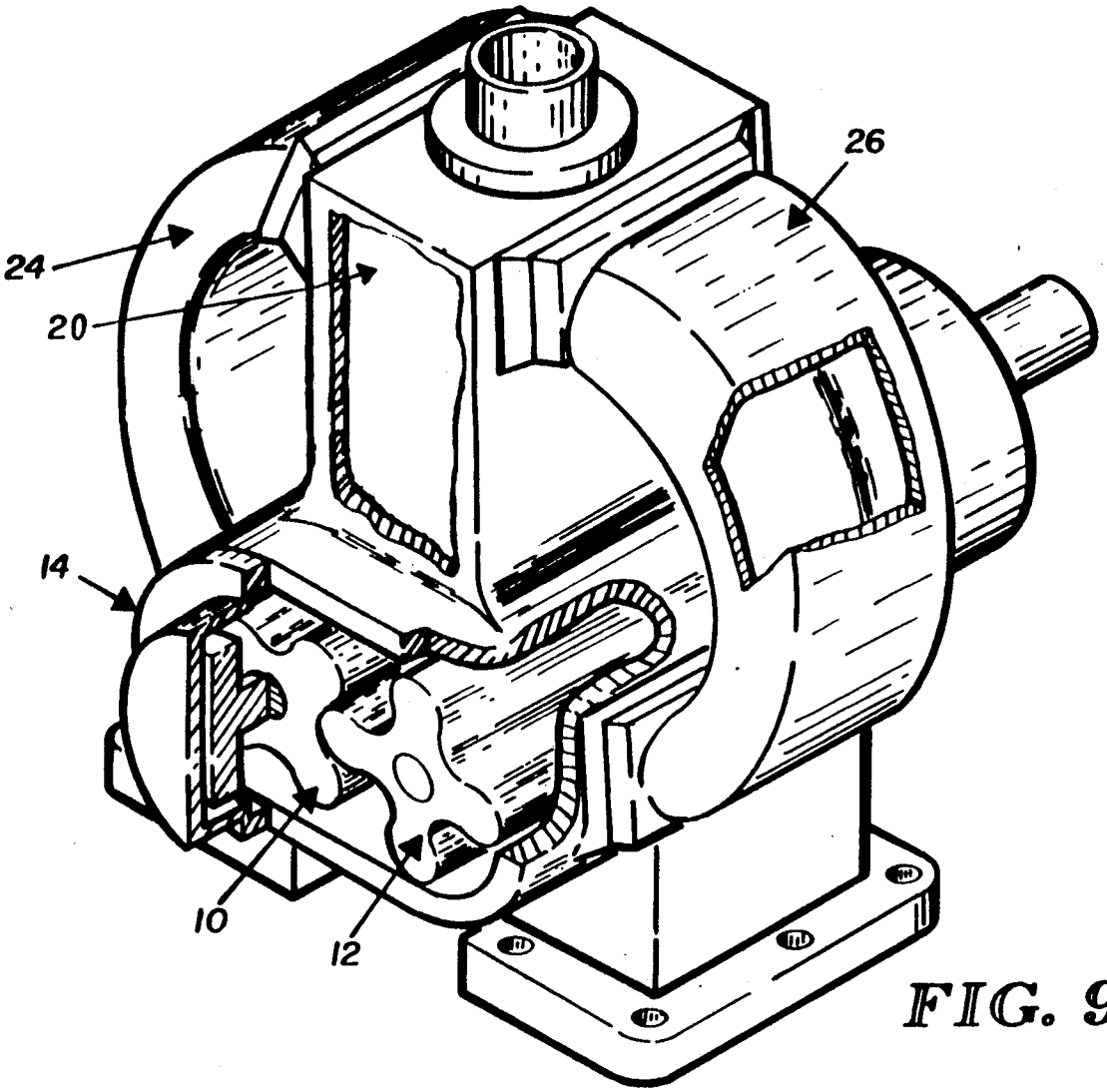
FIG. 9 is a partially cut away isometric view of a compressor substantially as shown in FIG. 1.

Referring particularly to FIGS. 1 and 9, there is illustrated a preferred embodiment of the positive displacement, recirculating rotary compressor of the present invention. The compressor includes two lobed impellers 10 and 12 which are rotatably mounting with a hollow housing 14. The housing 14 has an interior surface which includes two mutually opposing, cylindrically curved side walls 14*a* and 14*b*. The housing 14 further includes flat end walls, only one which, 14*c*, is shown. Briefly, the diameters of the lobed impellers 10 and 12 correspond, to within a preferable tolerance of a few thousandths of an inch, the diameters of the cylindrically curved side walls 14*a* and 14*b*. The lobed impellers 10 and 12 are substantially identical to one another, and will therefore be described in greater detail at various points below primarily by reference to the details of construction and operation of the impeller 10, shown generally on the left-hand side of the Figures. The impellers 10 and 12 each have four substantially identical lobes. Two of the four identical lobes of the impeller 10 are identified as 10*a* and 10*b* in certain of the Figures, for purposes of the description below.

Briefly, the impellers 10 and 12 are driven to rotate in opposite directions about parallel axes of rotation which extend along the central axes of the impellers. The axes of rotation of the impellers 10 and 12 are also colinear with the central longitudinal axes of the cylindrically curved interior walls 14*a* and 14*b*, respectively. The lobes of the impellers 10 and 12 have a maximum radius which is typically a few thousandths of an inch less than the geometric radius of the cylindrically curved side walls 14*a* and 14*b*. The impellers 10 and 12 are maintained in the proper angular relationship to one another, which is at an angular phase of 45° with respect to one another, by means of timing gears (not shown) which are located outside the primary chamber of the housing 14.

In operation, a gas is admitted to the compressor through a gas inlet port 16 which is formed at the lower end of the housing 14, and which is centered between the side walls 14*a* and 14*b*. The admitted gas is swept through the housing 14 by the impellers 10 and 12, and is discharged from the compressor through a discharge port 18, which is formed at the upper end of the housing 14, opposite the inlet port 16, and which is also centered between the side walls 14*a* and 14*b*. In rotation, the lobes of the impellers 10 and 12 intermesh in flush contact with one another, so that there is at all times a high-impedance clearance between the impellers, which clearance is small in comparison with the volumetric displacement of the compressor, and which essentially restrict, by sonic choking, backflow of high pressure discharge gas through the compressor.

The lobed impeller geometry results in continuous mesh contact between the impellers 10 and 12 throughout full rotation, such that backflow of the gas occurs only as a consequence of the tolerance, or play, between the impellers. The form of the individual lobes is involute between the tip and root radii.

Gas that is compressed and discharged from the discharge port 18 passes through a discharge conduit 20. In a preferred embodiment, discharge conduit 20 is coupled to a vapor condenser 22, in which gaseous vapors discharged from the compressor are condensed to a liquid form. In this application the compressor and condenser 22 are adapted to a refrigeration apparatus.

At a point in the discharge conduit 20 which is intermediate between the discharge port 18 and the condenser 20, the discharge conduit is connected in fluid communication to a pair of recirculation conduits 24 and 26. The recirculation conduits 24 and 26 connect the discharge conduit 20 to a pair of recirculation ports 28 and 30, respectively. The recirculation ports 28 and 30 open onto the cylindrically curved interior surfaces 14*a* and 14*b* of the housing 14.

The recirculation ports 28 and 30 open into the housing 14 so as to recycle high-pressure discharge gas back into the compressor housing 14, thereby raising the gas pressure in the housing 14 while largely avoiding the heat gain that results from adiabatic mechanical compression within the compressor, and reducing the tendency of the compressor to overheat at when the ratio of the intake gas pressure to the discharge gas pressure is high.

Figure 10:
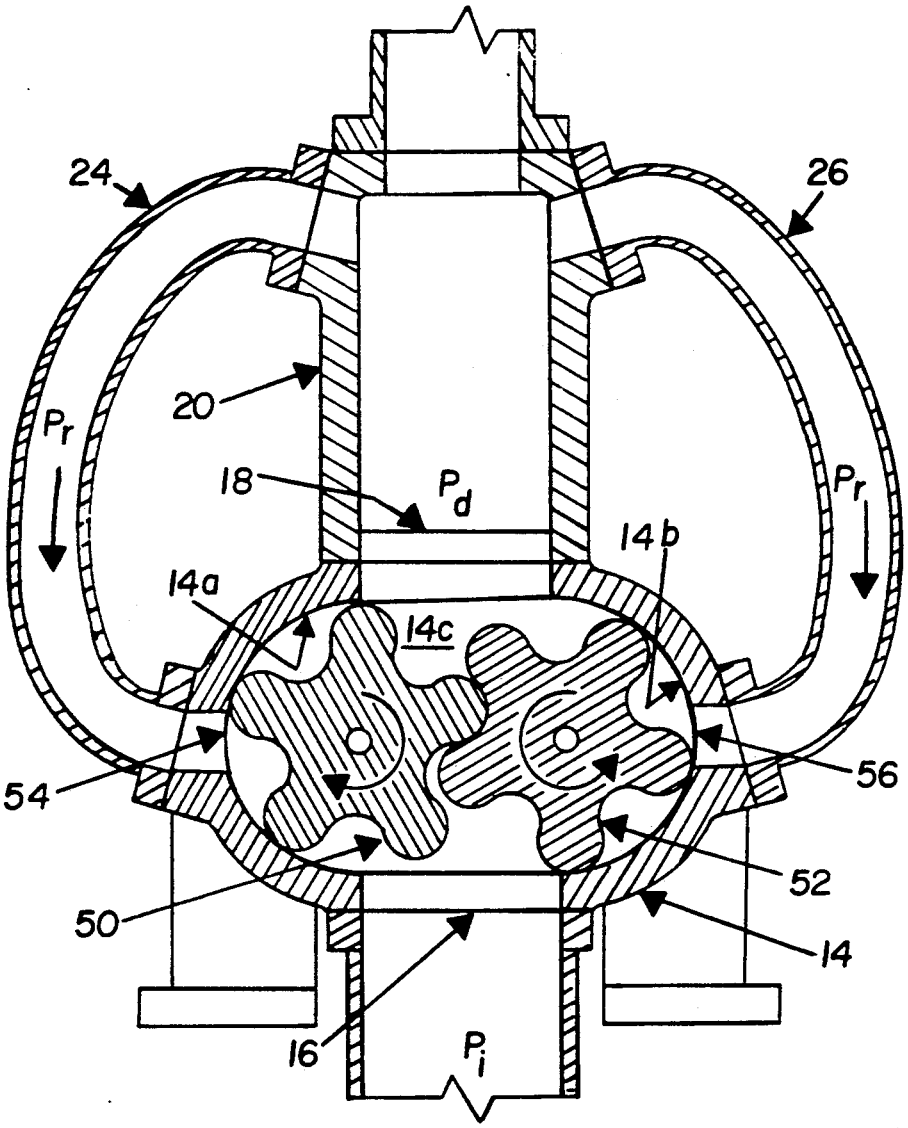
FIG. 10 is a schematic side view of an alternative embodiment of the compressor of the present invention, having a pair of five-lobed impellers.

It will be understood that all of the ports, namely the inlet port 16, discharge port 18, and recirculation ports 28 and 30, may be elongate in shape, extending parallel to the axes of the impellers, as suggested in FIG. 10.

In the Figures the recirculation conduits 24 and 26 are shown as being external to the housing 14. It will also be understood however that the recirculation conduits 24 and 26 may be formed as integral elements of a cast compressor housing 14, and that economies of manufacture, size and maintenance may suggest such a mode of construction.

The principle of operation of the compressor is illustrated in greater detail by the series of schematic illustrations set forth in FIGS. 2 through 8. These Figures illustrate the passage of a parcel of gas through the compressor in a step-by-step sequence. The following description of this sequence is primarily with reference to the left-hand half of the illustrated compressor, with it being understood that the operation of the right-hand side is identically the same. For convenience of description, the left-hand impeller 10 is illustrated as including four lobes, two of which are arbitrarily identified as lobes 10*a* and 10*b*. The operation of the compressor is perhaps best explained by following in some detail the course of a volume of gas as it is swept through the compressor.

Figure 2:
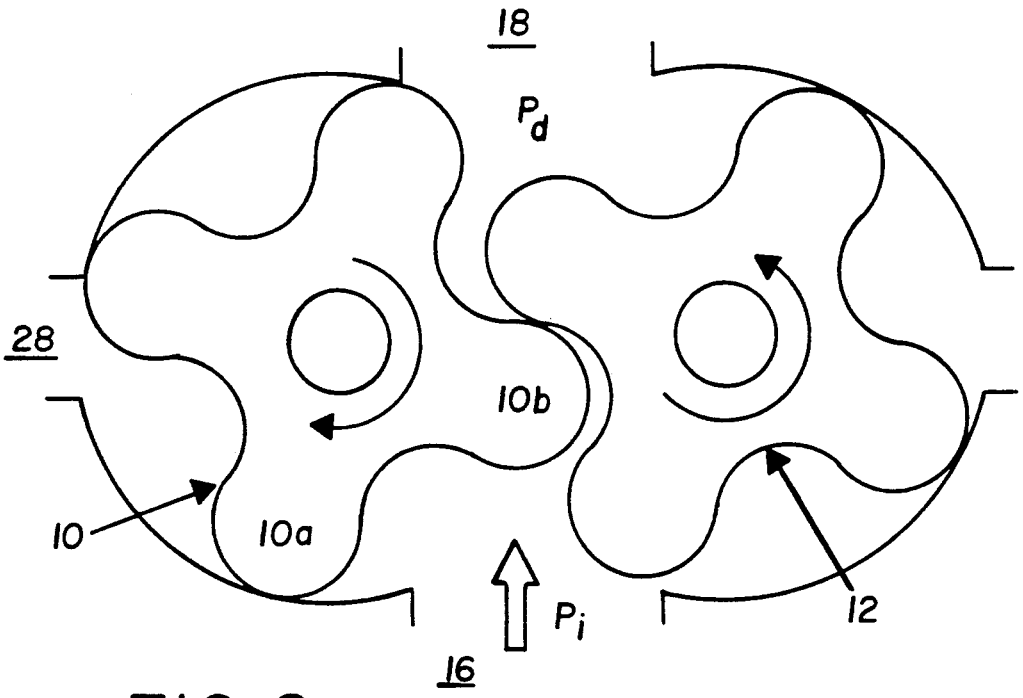
FIGS. 2 through 8 are schematic side views showing the operation of the present invention.
Figure 3:
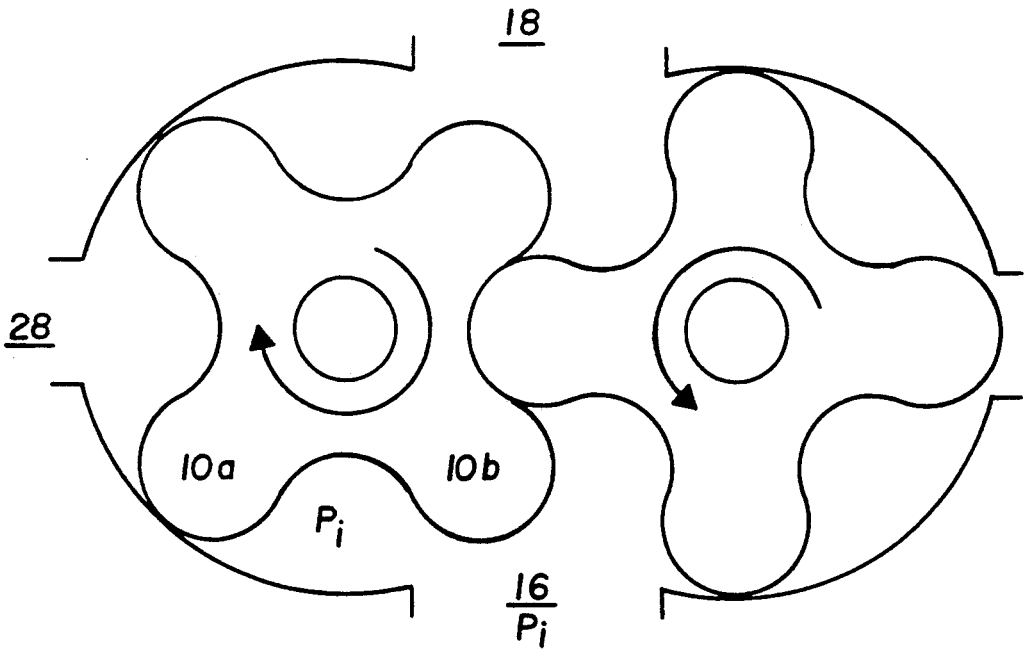
Figure 4:
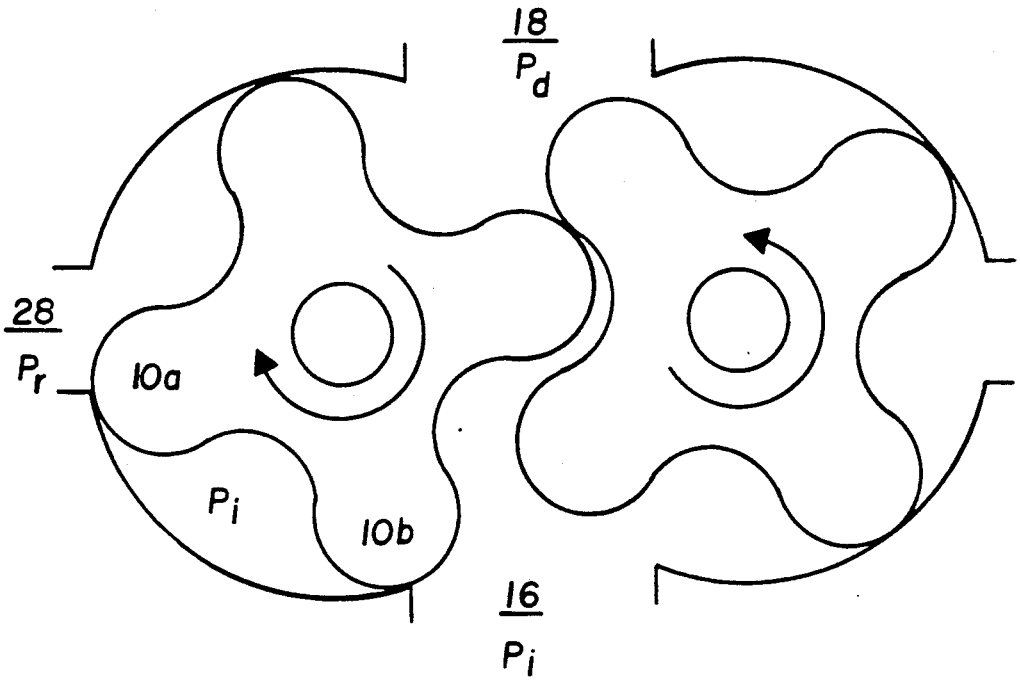

Referring first to FIG. 2, the compressor generally operates to pump a gas, which is at a relatively low initial pressure ($P_i$) at the inlet port 16, to the discharge port 18 at a relatively higher discharge pressure $P_d$. In the first step, gas is admitted at pressure $P_i$ to the compressor housing 14 through the inlet port 16. As lobes 10*a* and 10*b* rotate clockwise past the inlet port 16, as shown in FIG. 2 and 3, a parcel of gas is swept into the housing 14 and is trapped between lobe 10*a* and lobe 10*b*, which follows lobe 10*a* in rotation. At the point shown in FIG. 4, the parcel of gas is completely contained between lobes 10*a* and 10*b* and the housing walls, and is still at pressure $P_i$, with no compression having yet occurred. It will be noted that in the position shown in FIG. 4, the parcel of gas is not in communication with either the inlet gas at inlet port 16, or the recirculation gas at recirculation port 28. The volume in which the parcel of gas is trapped as shown in FIG. 4 is referred to herein as a displacement cavity.

Figure 5:
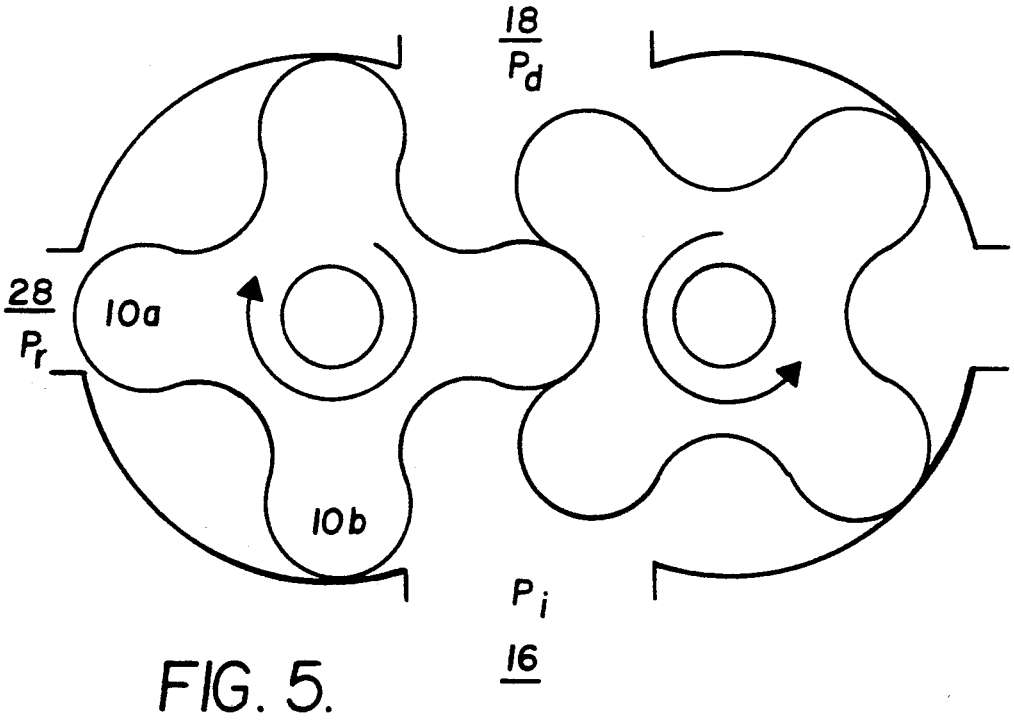

As the lobe 10*a* rotates clockwise past the leading edge of recirculation port 28, as shown in FIG. 5, recirculation gas is admitted to the displacement cavity containing the parcel of gas. The recirculation gas is at pressure $P_r$, which is higher than the inlet pressure $P_i$. The recirculation gas pressure $P_r$ may be at or near the discharge pressure $P_d$, or it may be somewhat lower than the discharge pressure $P_d$, depending on the gas being compressed, the extent to which it is cooled or condensed on discharge, and other factors.

Since in any event the recirculation gas pressure $P_r$ is higher than the inlet pressure $P_i$, there is a net flow of recirculation gas into the displacement cavity. The recirculation gas gains some heat as it enters the displacement cavity, due to a phenomenon known as flow work or flow energy conversion. The resulting increase in temperature tends to reach a substantially constant value at pressure ratios of greater than about five to one (5:1). This temperature increase is however sufficiently moderate to permit high pressure ratio operation, with minimum compressor clearances, without leading to thermal distortion and associated overheating problems. The housing 14 and the impellers 10 and 12 operate at a temperature which is near the temperature of the recirculation gas, and additional cooling measures are unnecessary.

Figure 6:
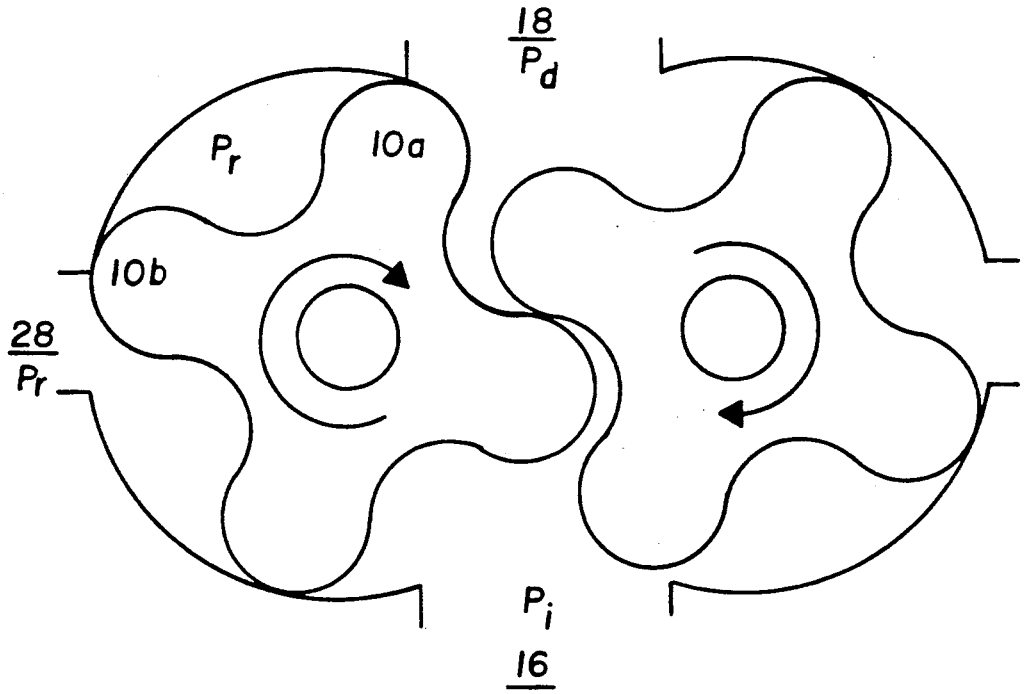

As a consequence of the introduction of the recirculation gas, there is created a new parcel of gas between lobes 10*a* and 10*b* which is at pressure $P_r$. As the lobes 10*a* and 10*b* continue past the recirculation port 28, there is momentarily trapped between these lobes the new parcel of gas, still at pressure $P_r$, which is not in communication with either the recirculation port 28 or the discharge port 18, as shown in FIG. 6.

Figure 7:
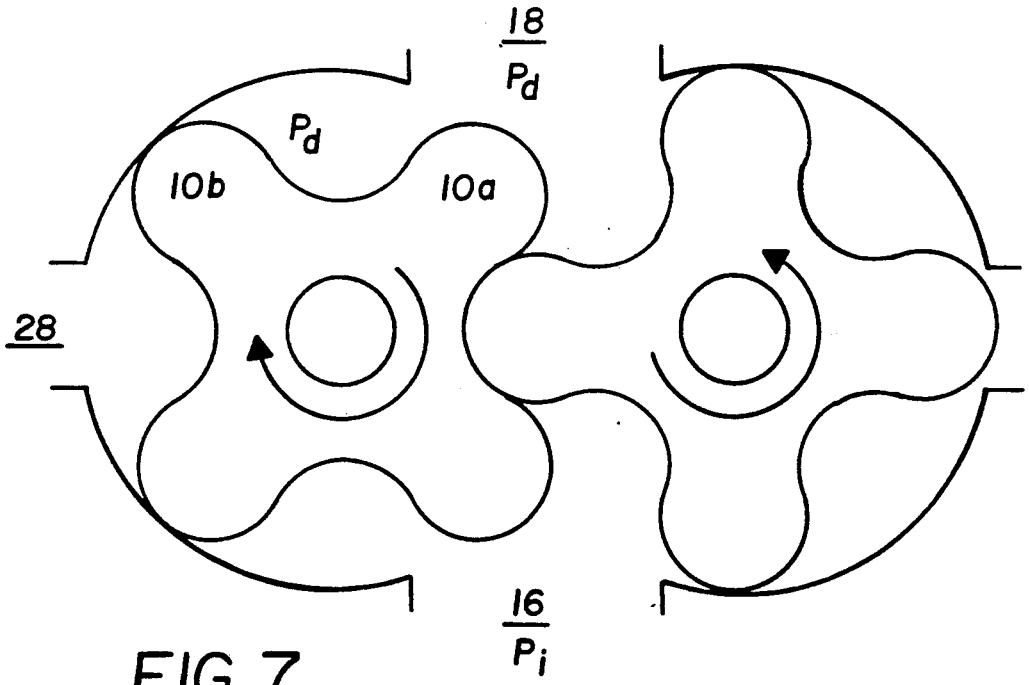
Figure 8:
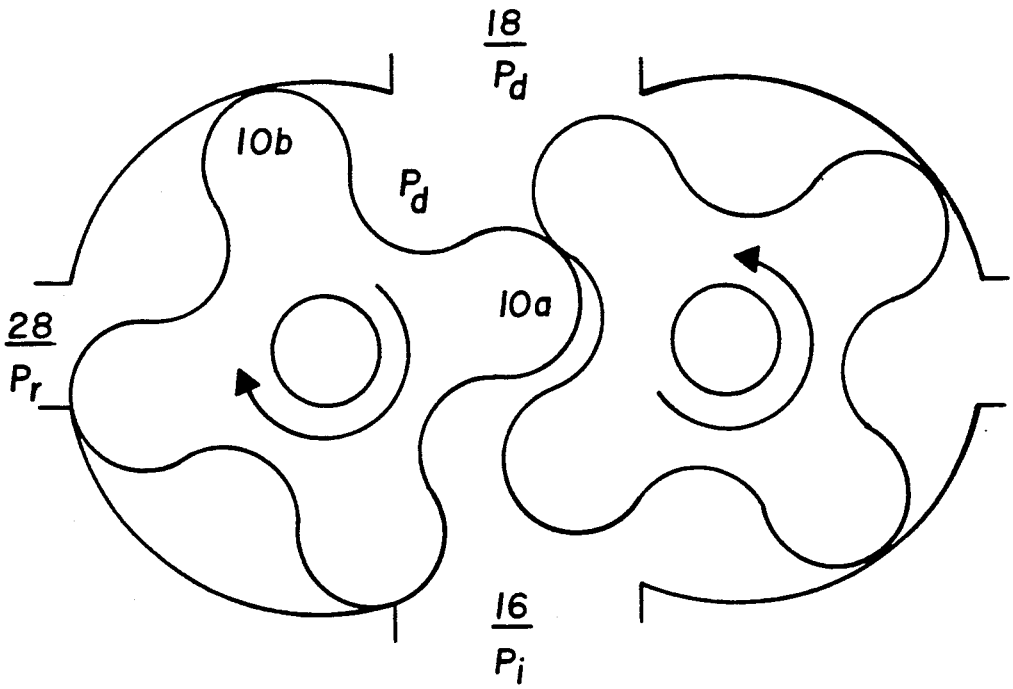

In the last stage, shown in FIGS. 7 and 8, lobe 10*a* passes the leading edge of the discharge port parcel of gas at pressure $P_r$ in the displacement cavity is discharged into the outlet conduit 20 and compressed to the discharge pressure $P_d$. The net result of the stages illustrated in FIGS. 2 through 8 is to compress the original parcel of gas at pressure $P_i$ to the higher discharge pressure $P_d$. This compression is substantially isothermal. Only a small amount of adiabatic compression occurs, the amount of which depends in part on the difference between the discharge pressure $P_d$ and the recirculation pressure $P_r$, which in turn depends on such factors and the degree of condensation or liquefaction of the gas. This difference in pressure, between the discharge pressure $P_d$ and the recirculation pressure $P_r$, is normally not greater than a few percent, such that there is only minimal heating of the gas passing through the compressor, and consequently only minimal heating of the compressor itself.

It will be noted that, with the illustrated impellers 10 and 12, which each have four lobes disposed at angles of 90° with respect to one another, it is necessary that the cylindrically curved interior side walls 14*a* and 14*b* each extend through angular sectors of at least 90° between the proximate edges of the inlet port 16 and the proximate edges of the respective recirculation ports 28 and 30. It will also be noted that the cylindrically curved side walls 14*a* and 14*b* also extend through angular sectors of 90° between the proximate edges of the discharge port 18 and the proximate edges of the respective recirculation ports 28 and 30. This ensures that the inlet port 16 is never in fluid communication with either of the recirculation ports 28 or 30, and that the discharge port 18 is likewise never in fluid communication with either of the recirculation ports 28 or 30. Although these angular sectors could be somewhat more than 90°, it will be appreciated that any larger angle effectively reduces the combined sizes of the inlet port 16, the outlet port 19, and the recirculation ports 28 and 30, with the result that there is greater flow impedance and reduced compression efficiency.

It will also be noted that one advantage of the embodiment thus far described is that the involute lobes of the impellers 10 and 12 do not at any time completely obstruct the recirculation ports 28 and 30 as the lobes of the impellers pass by the recirculation ports. This is illustrated, for example, in FIG. 5, where it will be seen that, even when the lobe 10*a* is centered on the port 28, recirculation as is free to flow into the displacement cavities on either side of lobe 10*a*. Consequently there is not any periodic interruption of the flow of recirculation gas by momentary closing of the recirculation ports 28 and 30, as there is in some of the rotary compressors previously available. Periodic interruption of the flow of recirculation gas is undesirable and inefficient because it results in a loss of momentum of the recirculation gas flow, with consequent heating and loss of flow velocity.

Turning to another important aspect of the invention, it will be noted from the Figures, particularly FIGS. 1 through 8, that both the absolute sizes and the relative sizes of the various ports are selected so as to minimize flow losses in the gases passing through the compressor. The relative sizes of the ports are preferably selected so as to maintain relatively constant flow velocity through all of the ports, including the recirculation conduits 24 and 26. More specifically, the inlet port 16 and the outlet port 18 are preferably sized approximately equally with respect to one another. The recirculation ports 28 and 30 are preferably also sized equally with respect to one another. Furthermore, the inlet port 16 and the outlet port 18 are each preferably approximately twice as large as each of the recirculation ports 28 and 30. Finally, all of the ports are made as large as possible within the constraints of these size relationships. This maximum size condition is achieved when the angular sectors of the interior housing walls 14*a* and 14*b* extend over angles of 90° between the proximate leading edges of the recirculation ports and each of the inlet and discharge ports. A 90° sector is of course the smallest angular sector that ensures against backflow, as discussed above. Making the ports as large as possible in this manner minimizes flow losses in the gas being compressed. Relative sizing of the ports in the manner just described results in the flow velocities being both equal and as low as possible. Low flow velocities of course are desired to minimize flow losses in the compressor.

FIG. 10 illustrates an alternative embodiment of the present invention, wherein the compressor includes a pair of impellers 50 and 52 which each have five lobes. All of the like-numbered elements of this embodiment are the same as in the four-lobed embodiment described above. In addition to the use of the five-lobed impellers 50 and 52, the principal difference between the embodiment shown in FIG. 10 and the previously described embodiment is that there are recirculation ports 54 and 56 which are somewhat larger than the recirculation ports 28 and 30 of the previously described embodiment. As discussed above, there is a definite advantage in having the recirculation ports being as large as possible. Larger recirculation ports are possible in this embodiment because of the relatively smaller angle (approximately 72°) between the lobes of a five-lobed impeller. To ensure against backflow, the cylindrically curved side walls in the alternative embodiment must extend through an angular sector of at least approximately 72°, between the proximate edges of the inlet port and the proximate edges of each of the recirculation ports. Likewise, the interior housing walls must extend through an angular sector of at least approximately 72° between the proximate edges of the discharge port and the proximate edges of each of the recirculation ports. Consequently the interior surface walls extend over a total angular sector of at approximately 288°. In all other regards the construction and operation of the alternative compressor is substantially identical to that of the preferred four-lobed embodiment described above. It will be appreciated that, with the impellers having five lobes, and thus a smaller angle between lobes, the inlet, outlet and recirculation ports can be made relatively larger than in the four-lobed embodiment. This leads to greater flow efficiency for the reasons discussed above, but with a lower overall volumetric efficiency than the four-lobed design, since the volumetric efficiency of a rotary compressor generally decreases with larger numbers of lobes. Thus it will be apparent that the embodiments of the present invention having impellers with greater numbers of lobes may have greater utility in applications where volumetric efficiency is less important than sustained operation at high pressure ratios. It will also recognized that a minimum of four lobes is necessary in the present invention in order to ensure against backflow due to direct momentary fluid communication between the discharge port and the recirculation ports, or between the recirculation ports and the inlet port.

Figure 11:
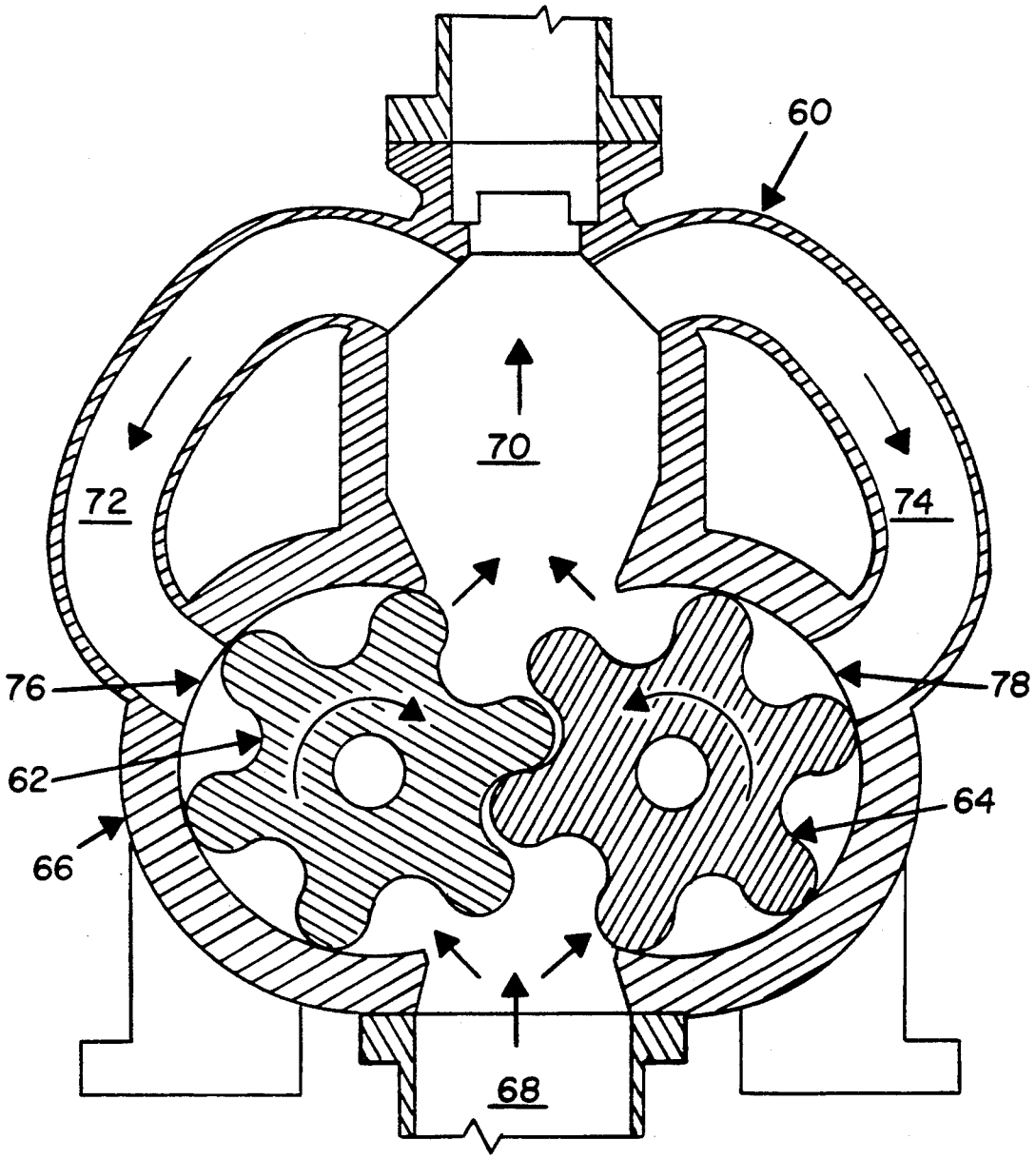
FIG. 11 is a side view in cross section of an alternative preferred embodiment of the rotary compressor, having two six-lobed impellers.
Figure 12:
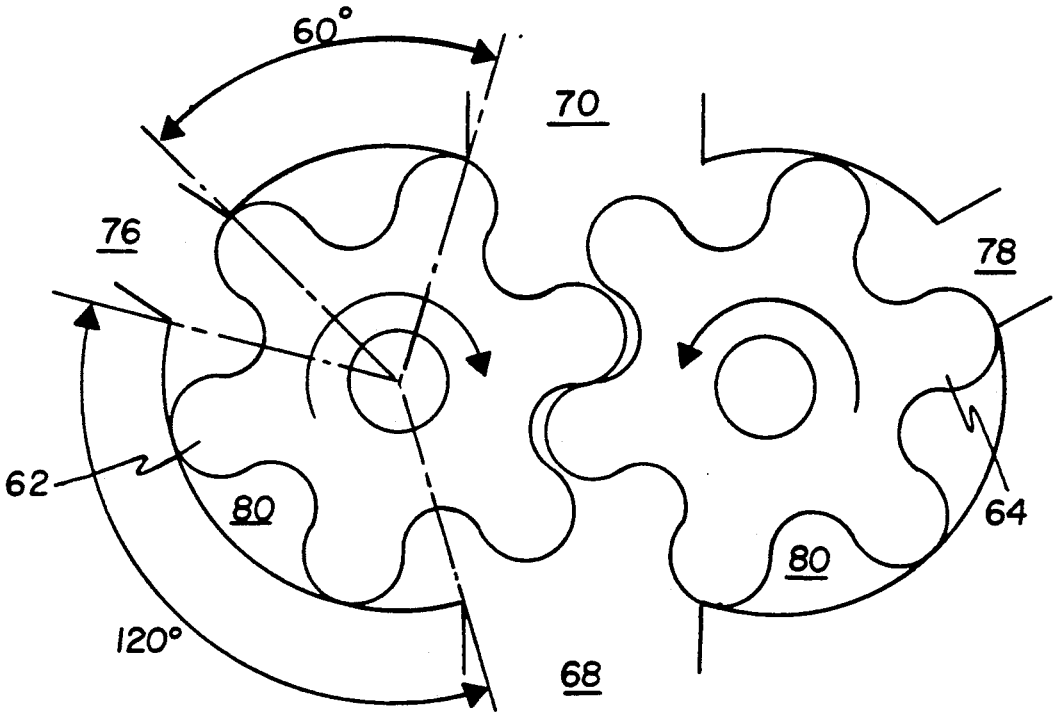
FIG. 12 is a schematic side view of the embodiment of FIG. 11.

FIGS. 11 and 12 illustrate another rotary gas compressor 60 which is an alternative preferred embodiment of the present invention. The compressor 60 includes two impellers 62 and 64, each of which has six involutely curved lobes. The adjacent lobes of each of the impellers 62 and 64 are thus disposed at angles of 60 degrees with respect to one another.

As in the embodiments described above, the compressor 60 includes generally a housing 66, an inlet port 68, discharge port 70, and recirculation conduits 72 and 74 with respective recirculation ports 76 and 78.

Referring to FIG. 12, the interior walls of the housing 60 extend over angular sectors of approximately 60 degrees between the edges of the discharge port 70 and proximal edges of the recirculation ports 76 and 78. The interior housing walls extend over angular sectors of approximately 120 degrees between the edges of the inlet port 68 and the proximal edges of the recirculation ports 76 and 78.

The advantage to using the six-lobed impellers and the housing structure described above is that there is greater resistance to backflow between each of the recirculation ports 76 and 78 and the inlet port 68. This is because there is interposed at all times at least two rotor lobes between each of the recirculation ports 76 and 78 and the inlet port 68. This is in contrast to the four- and five-lobed embodiments described above, in which there is only one lobe interposed between the recirculation ports and the inlet port. Consequently the six-lobed embodiment offers approximately twice the resistance to backflow from the recirculation ports 76 and 78 to the inlet port 68. Further, there is at all times an intercept cavity 80 (FIG. 12) positioned between the recirculation ports 76 and 78 and the inlet port 68. The intercept cavity 80 functions to intercept and collect peripheral slippage gas and carries it forward to the recirculation system. Peripheral slippage gas is gas which flows from the recirculation ports 76 and 78 toward the inlet port 68, by flowing past the ends of the impeller lobes through the clearance space between the ends of the lobes and the housing wall. As a consequence of the intercept cavities 80, the only significant slippage is that of gas which slips through the rotor mesh (the point where the two impellers 62 and 64 intermesh), directly from the discharge port 70 to the inlet port 68.

Impellers having longer lobes have proportionally lower end slippage losses than impellers having shorter lobes, although short lobes are substantially as efficient as long lobes for a comparable center distance. However, displacement for a comparable center distance and lobe length is about one-third less for the six-lobed embodiment than for the four-lobed embodiment.

Regardless of the number of lobes utilized in the impellers, the relatively high pressure ratio capability of the compressor of the present invention is a consequence of the fact that the pressure gain in the housing is largely a result of flow work, which results from optimizing the flow of recirculation gas, as opposed to adiabatic compression and associated heating. In this regard, with increasing gas pressure ratios flow work becomes asymptotic, whereas temperature increases due to adiabatic, or isentropic, compression are exponential.

It is believed that the compressor of the present invention will find utility in a wide variety of applications where high volume, sustained pumping is required at pressure ratios of up to approximately ten to one (10:1). Inasmuch as Roots compressors have previously only been capable of sustained operation at pressure ratios of approximately four to one (4:1), due to limitations imposed by heating of the compressor components, the higher attainable pressure ratio capability of the present invention will make it useful in a wide variety of applications where the use of positive displacement rotary Roots compressors has not been previously considered feasible These new applications will indeed be useful, because of the general advantages of positive displacement rotary pumps mentioned above; namely, simplicity, high volumetric efficiency, and the absence of rubbing or reciprocating mechanical components. Moreover, compressor units can be hermetically sealed, or can be sealed by the use of non-leakage shaft seals. This feature is a major consideration, for example, in the chemical processing industry; for gaseous laser discharge systems; for microchip processing vacuum systems; and for food industry freeze drying systems.

Further, as already noted the present invention has particularly useful application to refrigeration cycles. One reason for this is that any condensation, or liquefaction, that may occur within the compressor itself will reduce backfill and slippage. Additionally, in such a wet-compression situation both volumetric and thermal efficiencies are enhanced, and the thermal load on the associated condenser is reduced.

It will also be appreciated that the working fluid temperature throughout the compressor remains nearly constant. No significant waste heat is generated, and the problems and limitations associated with thermal distortion are avoided. This feature is not present in any previously available positive displacement compressor. The compressor provides an inherent energy efficiency advantage improves with increasing compression ratio. The compressor is characterized by a nearly uniform working fluid temperature, which is a distinct advantage in many chemical processing applications.

Yet another advantage of the present invention is its quiet operation. Since there is no significant pressure pulse into the discharge gas, noise commonly generated at this point in other compressors is greatly reduced.

Although the present invention is described herein with reference to a preferred embodiment and an alternative embodiment, it will be understood that various modifications, substitutions and alterations, which may be apparent to one of ordinary skill in the art, may be made without departing from the essence of the invention. Accordingly, the present invention is defined by the following claims.

The embodiments of the invention in which patent protection is claimed are defined as follows:

1. A positive displacement recirculating rotary compressor comprising a housing having two mutually opposing cylindrically curved interior side walls; said housing including a gas inlet port at one end located between said mutually opposing cylindrically curved side walls; and a gas discharge port located at the opposite end of said housing from said inlet port and also located between said mutually opposing cylindrically curved interior side walls; said housing further including first and second gas recirculation ports formed respectively in said cylindrically curved opposing side walls between said inlet port and said discharge port; first and second involutely lobed impellers journalled for rotation in opposite directions within said housing; each of said impellers having at least four lobes; said impellers being intermeshed so as to form a high-impedance seal when said impellers are rotated in opposite directions; said discharge port being connected in fluid communication with a discharge conduit; first and second recirculation conduit means connected in fluid communication with said discharge conduit and connecting said discharge conduit respectively to said first and second recirculation ports; said inlet port and said discharge port being approximately equal in size to one another; said discharge port being approximately twice the size of each of said recirculation ports; said inlet, discharge and recirculation ports being isolated from direct fluid communication with one another and further being as large as possible within the constraints of the foregoing size relationships; whereby gas discharged from said housing returns to said housing through said recirculation ports so as to reduce heating of said impellers; and with the sizing of said inlet, discharge and recirculation ports thereby resulting in minimal flow losses.

2. The positive displacement recirculating rotary compressor defined in claim 1 wherein each of said impellers has four lobes.

3. The positive displacement recirculating rotary compressor defined in claim 2 wherein said cylindrically curved interior walls of said housing extend through angular sectors of at least ninety degrees between the proximate edges of said discharge port and said recirculation ports, such that said inlet port is isolated from direct fluid communication with said recirculation ports, and such that said discharge port is isolated from direct fluid communication with said recirculation ports.

4. The positive displacement recirculating rotary compressor defined in claim 1 wherein each impeller has five lobes.

5. The positive displacement recirculating rotary compressor defined in claim 1 further comprising a vapor condenser connected in fluid communication with said discharge conduit.

6. The positive displacement recirculating rotary compressor defined in claim 4 wherein said cylindrically curved interior side walls of said housing each extend through angular sectors of at least seventy two degrees between the proximate edge of said inlet port and the respective recirculation port, and between the proximate edge of said discharge port and the respective recirculation port, such that said inlet port is isolated at all times from direct fluid communication with said recirculation ports, and said discharge port is also isolated at all times from direct fluid communication with said recirculation ports.

7. A positive displacement recirculating rotary compressor comprising:

a housing having two mutually opposing cylindrically curved interior side walls, said housing including a gas inlet port at one end located between said mutually opposing cylindrically curved side walls, and a gas discharge port located at the opposite end of said housing from said inlet port and also located between said mutually opposing cylindrically curved interior side walls, said housing further including first and second gas recirculation ports formed respectively in said mutually opposing cylindrically curved side walls between said inlet port and said discharge port;

first and second involutely lobed impellers journalled for rotation in opposite directions within said housing, each of said impellers having at least four lobes, said impellers being intermeshed so as to form a high-impedance seal when said impellers are rotated in opposite directions;

first and second recirculation conduits connecting said discharge port in fluid communication with said first and second recirculation ports respectively;

said interior mutually opposing cylindrically curved walls extending over an angular sector between proximate edges of said discharge port and each of said recirculation ports, and also extending over said angular sector between proximate edges of said inlet port and each of said recirculation ports, said angular sector being at least as large as the approximate angular relationship between adjacent lobes of each of said impellers;

said inlet port and said discharge port being approximately equal in size to one another; said discharge port being approximately twice the size of each of said recirculation ports; said inlet, discharge and recirculation ports being isolated from direct fluid communication with one another and further being as large as possible within the constraints of the foregoing size relationships;

whereby direct fluid communication is prevented between said discharge port and said recirculation ports and between said recirculation ports and said inlet port, and further whereby the total size of said ports is maximized so as to minimize gas flow losses in said compressor.

8. The positive displacement recirculating rotary compressor defined in claim 7 wherein said angular sector is substantially equal to said angular relationship between adjacent lobes each of said impellers.

9. The positive displacement recirculating rotary compressor defined in claim 8 wherein each of said impellers has four lobes, and wherein said interior opposing walls extend over angular sectors of approximately 90°.

10. The positive displacement recirculating rotary compressor defined in claim 9 further comprising a vapor condenser connected in fluid communication with said discharge port.

11. The positive displacement recirculating rotary compressor defined in claim 9 wherein said inlet port and said discharge port are approximately equal in size to one another, and wherein said discharge port and said inlet port are each approximately twice the size of each of said recirculation ports, whereby gas flow velocities are equalized to further minimize gas flow losses.

12. The positive displacement recirculating rotary compressor defined in claim 8 wherein each of said impellers has five lobes, and wherein said interior opposing walls extend over angular sectors of approximately 72°.

13. The positive displacement recirculating rotary compressor defined in claim 12 wherein said inlet port and said discharge port are approximately equal in size to one another, and wherein said discharge port and said inlet port are each approximately twice the size of each of said recirculation ports, whereby gas flow velocities are equalized to further minimize gas flow losses.

14. The positive displacement recirculating rotary compressor defined in claim 13 further comprising a vapor condenser connected in fluid communication with said discharge port.

15. A positive displacement recirculating rotary compressor comprising:

a housing having two mutually opposing cylindrically curved interior side walls, said housing including a gas inlet port at one end located between said mutually opposing cylindrically curved side walls, and a gas discharge port located at the opposite end of said housing from said inlet port and also located between said mutually opposing cylindrically curved interior side walls, said housing further including first and second gas recirculation ports formed respectively in said mutually opposing cylindrically curved side walls between said inlet port and said discharge port, said first and second gas recirculation ports being connected in fluid communication with said discharge port;

first and second involutely lobed impellers journalled for rotation in opposite directions within said housing, each of said impellers having six lobes, said impellers being intermeshed so as to form a high-impedance seal when said impellers are rotated in opposite directions;

said interior mutually opposing cylindrically curved walls extending over a first angular sector between proximal edges of said discharge port and each of said recirculation ports, and said interior mutually opposing cylindrically curved walls extending over a second angular sector between proximal edges of said inlet port and each of said recirculation ports, said first and second angular sectors each being at least as large as the approximate angular relationship between adjacent lobes of each of said impellers, whereby direct fluid communication is prevented between said discharge port and said recirculation ports and between said recirculation ports and said inlet port, so as to minimize gas flow losses in said compressor;

said inlet port and said discharge port being approximately equal in size to one another, and said recirculation ports being of approximately equal size with respect to one another, and said discharge port and said inlet port each being approximately twice the size of each of said recirculation ports, whereby gas flow velocities are equalized to minimize gas flow losses, and further wherein the sizes of said inlet port, discharge port, and recirculation ports are maximized within the constraints of the foregoing size relationships, whereby gas flow velocities in said compressor are further minimized.

16. The positive displacement recirculating rotary compressor defined in claim 15 wherein said first angular sector between proximal edges of said discharge port and each of said recirculation ports is approximately sixty (60) degrees and wherein said second angular sector is approximately one hundred and twenty (120) degrees.

17. The positive displacement recirculating rotary compressor defined in claim 15 wherein said first angular sector between proximal edges of said discharge port and each of said recirculation ports is at least sixty (60) degrees and wherein said second angular sector is at least one hundred and twenty (120) degrees.

18. The positive displacement recirculating rotary compressor defined in claim 15 further comprising a vapor condenser connected in fluid communication with said discharge port.

* * * * *